US011600954B2

(12) United States Patent
Bredbeck et al.

(10) Patent No.: US 11,600,954 B2
(45) Date of Patent: Mar. 7, 2023

(54) CABLE CORE CROSSING DEVICE

(71) Applicant: Rosenberger Hochfrequenztechnik GmbH & Co. KG, Fridolfing (DE)

(72) Inventors: Till Bredbeck, Traunstein (DE); Gunnar Armbrecht, Tittmoning (DE); Martin Zebhauser, Laufen (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 71 days.

(21) Appl. No.: 17/259,846

(22) PCT Filed: May 22, 2019

(86) PCT No.: PCT/EP2019/063161
§ 371 (c)(1),
(2) Date: Jan. 12, 2021

(87) PCT Pub. No.: WO2020/011436
PCT Pub. Date: Jan. 16, 2020

(65) Prior Publication Data

US 2021/0273381 A1 Sep. 2, 2021

(30) Foreign Application Priority Data

Jul. 13, 2018 (EP) ..... 18183364

(51) Int. Cl.
*H01R 13/6581* (2011.01)

(52) U.S. Cl.
CPC ..... *H01R 13/6581* (2013.01)

(58) Field of Classification Search
CPC ..... H01R 13/6581; H01R 13/6467; H01R 13/6471; H01R 24/64
USPC ..... 439/607.55
See application file for complete search history.

(56) References Cited

U.S. PATENT DOCUMENTS

| | | | | |
|---|---|---|---|---|
| 1,953,594 | A * | 4/1934 | Douglas | H01R 24/30 439/660 |
| 3,980,380 | A * | 9/1976 | Cieniawa | H01R 24/38 439/656 |
| 5,483,020 | A | 1/1996 | Hardie et al. | |
| 5,601,447 | A | 2/1997 | Reed et al. | |
| 6,764,350 | B2 * | 7/2004 | Kosmala | H01R 9/0518 439/607.41 |
| 7,044,789 | B2 * | 5/2006 | Yohn | H01R 13/6592 439/599 |
| 7,473,850 | B2 * | 1/2009 | Glew | H01B 11/06 174/113 C |
| 7,494,377 | B2 * | 2/2009 | Yohn | H01R 9/03 439/460 |

(Continued)

FOREIGN PATENT DOCUMENTS

| | | | |
|---|---|---|---|
| CN | 1193418 | A | 9/1998 |
| CN | 104428958 | A | 3/2015 |

(Continued)

*Primary Examiner* — Peter G Leigh
(74) *Attorney, Agent, or Firm* — David P. Dickerson

(57) ABSTRACT

Guide element for electrical cores in a cable with at least four guide tracks, one for each electrical core of the cable, wherein the guide tracks run in such a way that at a first end of the guide element, at least two cores exchange places relative to a second end of the guide element opposite the first end.

22 Claims, 4 Drawing Sheets

(56) References Cited

U.S. PATENT DOCUMENTS

| | | | | |
|---|---|---|---|---|
| 7,972,183 | B1 * | 7/2011 | Lin | H01R 13/6463 439/676 |
| 8,403,699 | B1 * | 3/2013 | MacNeil | H01R 13/582 439/460 |
| 8,791,365 | B2 * | 7/2014 | Pyczak | H02G 1/00 174/113 R |
| 8,979,553 | B2 * | 3/2015 | Lloyd | H01R 13/502 439/76.1 |
| 8,993,887 | B2 * | 3/2015 | Parham, Jr. | H02G 15/076 439/399 |
| 9,601,885 | B2 * | 3/2017 | Fransen | H01R 24/64 |
| 9,734,940 | B1 | 8/2017 | Mcnutt et al. | |
| 9,819,124 | B2 * | 11/2017 | Oberski | H01R 13/6469 |
| 9,853,369 | B2 * | 12/2017 | Oberski | H01R 13/6658 |
| 2005/0227545 | A1 | 10/2005 | Lahoreau et al. | |
| 2006/0035513 | A1 | 2/2006 | Yohn et al. | |
| 2008/0014801 | A1 * | 1/2008 | Milette | H01R 4/242 439/638 |
| 2011/0108306 | A1 | 5/2011 | Parham, Jr. et al. | |
| 2015/0349472 | A1 | 12/2015 | Zebhauser et al. | |
| 2017/0250009 | A1 | 8/2017 | Koeppendoerfer | |

FOREIGN PATENT DOCUMENTS

| | | | | |
|---|---|---|---|---|
| CN | 107112092 | A | 8/2017 | |
| DE | 0431408 | A2 * | 6/1991 | H01R 13/623 |
| DE | 196 49 668 | C1 | 5/1998 | |
| DE | 202005009962 | U1 * | 9/2005 | H01R 13/422 |
| DE | 20 2014 009 499 | U1 | 1/2015 | |
| DE | 10 2016 008 679 | A1 | 1/2018 | |
| EP | 1 241 740 | A1 | 9/2002 | |
| EP | 2 431 981 | A2 | 3/2012 | |
| EP | 2 697 804 | | 10/2012 | |
| EP | 3 163 688 | A1 | 5/2017 | |
| FR | 2868884 | A1 * | 10/2005 | H01R 13/502 |
| JP | 2004139862 | A | 5/2004 | |
| WO | WO-2016132855 | A1 * | 8/2016 | |

* cited by examiner

CABLE CORE CROSSING DEVICE

FIELD OF THE INVENTION

The present invention relates to a guide element for electrical cores in a cable.

TECHNICAL BACKGROUND

Document EP 2697804 B1 discloses a star-quad cable.

U.S. Pat. No. 5,483,020 A discloses a cable with cores arranged as a parallel pair ("parallel pair" cable).

SUMMARY OF THE INVENTION

The present invention is of utility for combining star-quad cables and "parallel pair" cables.

Inter alia, the present disclosure teaches:

a guide element for electrical cores in a cable with at least four guide tracks, one for each electrical core of the cable, wherein the guide tracks run in such a way that at a first end of the guide element, at least two cores exchange places relative to a second end of the guide element opposite the first end; and a cable having at least four cores, which are guided in a first section in a star-quad arrangement and in a second section as parallel pairs, wherein the cable has a guide element between the first section and the second section, by means of which the cores are converted from the star-quad arrangement into an arrangement as parallel pairs.

The idea underlying the present invention is to create a guide element which guides cores of a cable such that at least two cores exchange places in the cable.

In this application, the term connector arrangement is used to mean a cable connected to a connector.

The idea underlying the present invention also consists of changing from a star-quad arrangement of the cores in a cable to an arrangement of the cores as parallel pairs. This change of arrangement is achieved by two cores of the cable exchanging places. The exchange of places is guided by the guide element.

A place of a core is understood to mean a position of the core in relation to other cores of the cable. For example, a four-core cable has four places, for example, top right, bottom right, top left, bottom left or outer right, center right, center left, outer left.

A star-quad cable, i.e. a cable with cores in a star-quad arrangement, is a symmetrical type of cable. In this type of cable, four cores are stranded together in the shape of a cross. Accordingly, in a cross-sectional view of the star-quad the four cores are arranged at the corners of a square, the cores of a pair being arranged at diagonally opposite corners. The resulting perpendicularly arranged core pairs produce a desirable high attenuation of crosstalk from one pair to the other pair. A further advantage of the star-quad stranding, in addition to the mechanical stabilization of the arrangement of the conductors relative to each other, is a higher packing density than is obtained with a paired stranding.

Wire cores in a parallel pair arrangement are not arranged diagonally in pairs, but next to each other in pairs. A pair of cores of a "parallel pair" cable is often shielded by a core-pair shield.

Advantageous embodiments and extensions are obtained from the additional dependent claims and from the description, with reference to the figures of the drawing.

It goes without saying that the aforementioned features and those yet to be explained below can be applied not only in the corresponding specified combination, but also in other combinations or in isolation without departing from the scope of the present invention.

In some embodiments, the guide element converts a star-quad arrangement of the cores/electric contacts into an arrangement of parallel pairs. This allows star-quad cables/connectors or "parallel pair" cables/connectors and "parallel pair" cables/connectors to be combined. This allows the advantages of both systems to be used and/or combined with each other.

In some embodiments, the guide tracks are formed at a first end of the guide element at the top right, bottom right, top left and bottom left. It goes without saying that the guide tracks in a crossover region of the guide element can be arranged differently in order to implement the place exchange of the cores. This arrangement is particularly compact.

In some embodiments, the guide tracks are formed in such a way that the place exchange is carried out from a right-hand core to a left-hand core and from a left-hand core to a right-hand core, or from an upper to a lower core and from a lower core to an upper core. With symmetrical guide elements, it goes without saying that the specifications left/right or upper/lower can be identical apart from a rotation.

In some embodiments, the guide element has means for compensating for a length offset. A length offset is generated due to a difference in length between a plurality of cores. Accordingly, it is possible that the length of the place-changing conductors is different from that of the rest of the cores. Accordingly, it can be provided that the guide tracks of the non-place-changing cores are artificially lengthened with respect to the guide tracks of the place-changing cores, for example, by the guide tracks of the non-place-changing cores being curved in such a way that the guide tracks are extended to the same length of a guide track of a place-changing core.

In some embodiments, the guide element has a shield element at the first end and/or at the second end. Therefore, the shielding of the cores in the region of the guide element can be improved.

In this case it is advantageous if the shield element is cross-shaped and can be arranged centrally between the cores. Thus, the mutual shielding of the cores in the region of the guide element can be improved.

In some embodiments, the guide element can be mounted in different orientations, in particular, in eight orientations. Accordingly, it can be provided that the guide tracks are designed rotationally symmetric to each other. This facilitates the assembly of the guide element, since the guide element cannot then be mounted the wrong way round. This is particularly advantageous in the case of a robot-assisted assembly.

In some embodiments, the guide element has a groove on one side face, in particular a groove on each of two opposite side faces. This creates a particularly simple and effective fixation means or locking means of the guide element.

In some embodiments, the guide element has walls, which are formed perpendicularly between the guide tracks for shielding the cores. It goes without saying that the walls in the crossover region of the place-changing cores can be interrupted. In this way, the shielding of the cores from each other in the region of the guide element can be further improved.

In some embodiments, the at least two cores, with respect to which the place exchange is obtained, are crossed over in a crossover region.

In some embodiments, the guide element has at least one, in particular two, shielded region(s) in which the cores are shielded from each other by the guide element, and in particular, if the at least two cores, with respect to which the place exchange is obtained, are not shielded from each other by the guide element in the crossover region.

Due to the shielding the electrical properties of the guide element are improved. Accordingly, a guide element with a shielded region can be used in transmission lines with higher data transfer rates.

It is a further advantage in this case if the guide element is designed such that the shielded region is designed to be as long as possible. It is thus possible to minimize a discontinuity in the impedance due to an unshielded section.

The electrical properties can be further improved by the two cores, with respect to which the place exchange is obtained, being shielded from each other in the crossover region by a separate outer conductor, in particular, by an outer conductor film. In the crossover region, shielding of the crossover region requires high constructional and production effort. However, the production of a guide element is simplified if the cores are not shielded in the crossover region. In this case, shielding of the cores can be ensured by other means, such as an outer conductor foil. It is thus possible to ensure a similar improvement of the electrical properties compared to the alternative design of a guide element with a shielded crossover region.

In accordance with a preferred extension of the invention, the guide tracks run in such a way that no place exchange of two cores is obtained at the first end of the guide element relative to the second end, wherein the guide tracks are shaped in such a way that the two cores, with respect to which no place exchange is obtained, are shielded over an entire length of the guide element.

It is thus possible to provide a shielding of the non-place-changing cores without great constructional effort or production effort.

Where practical, the above embodiments and extensions can be combined with each other in any way desired. Further potential embodiments, extensions and implementations of the invention also comprise combinations of features of the invention either described previously or in the following in relation to the exemplary embodiments, which are not explicitly mentioned. In particular, the person skilled in the art will also be able to add individual aspects as improvements or additions to each basic form of the present invention.

DESCRIPTION OF THE CONTENT OF THE DRAWING

The present invention will now be described in more detail with the aid of the exemplary embodiments given in the schematic Figures of the drawings. Shown are:

Figure 1:
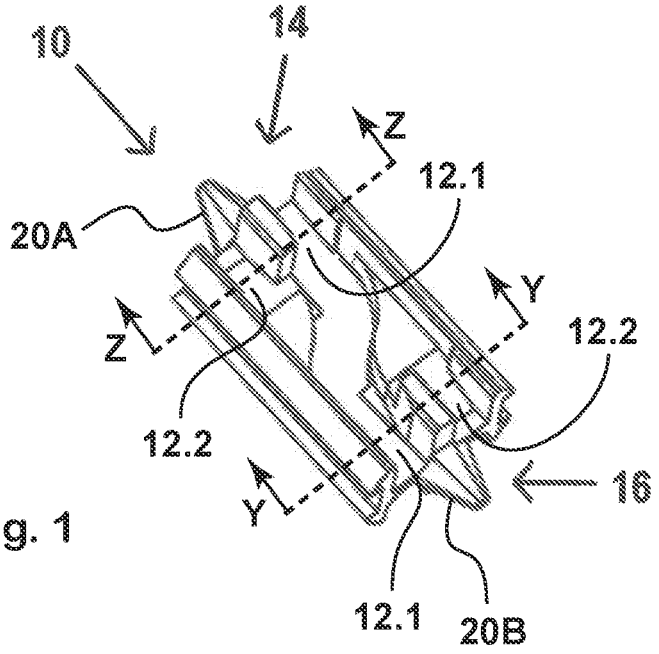
FIG. 1 shows a perspective view of a guide element according to one embodiment of the invention.
Figure 1A:
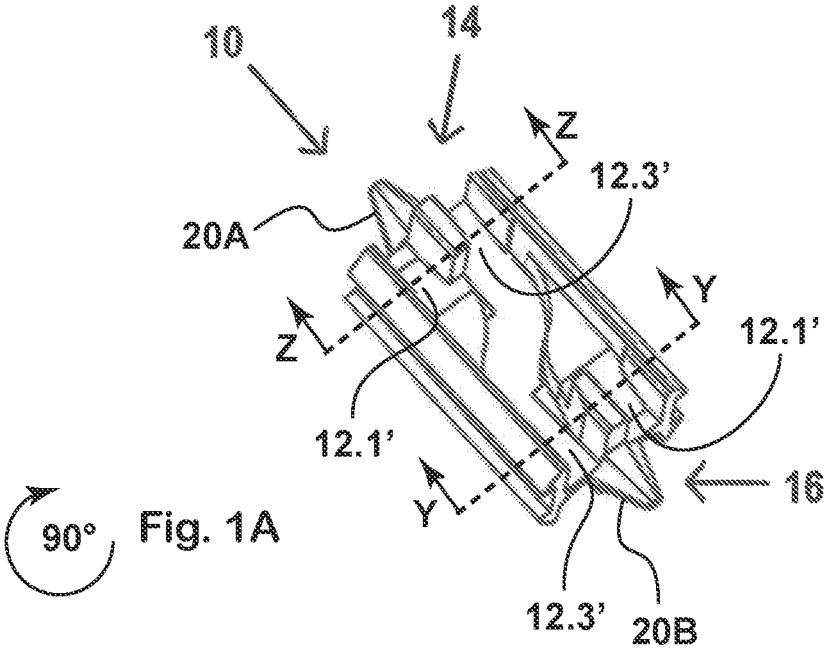
FIG. 1A shows a perspective view of an alternative configuration of the guide element of FIG. 1.
Figure 4:
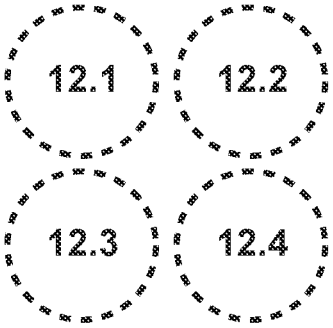
Figure 4A:
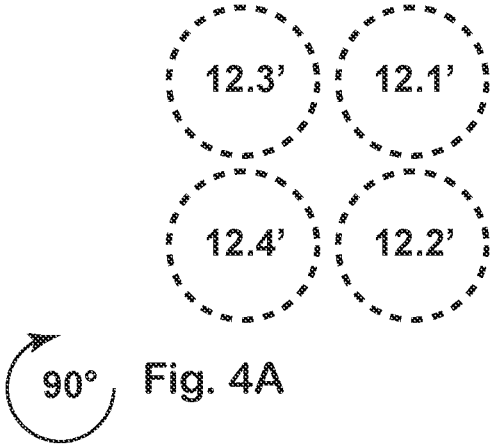
Figure 5:
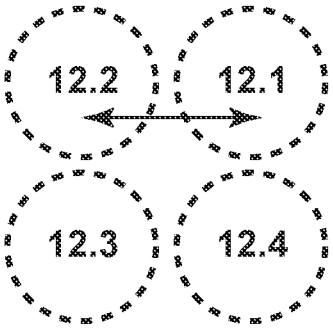
Figure 5A:
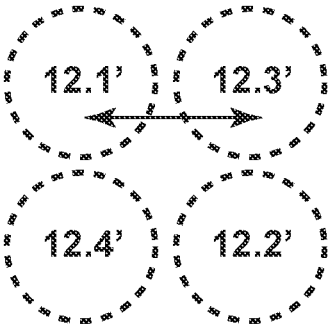
Figure 6:
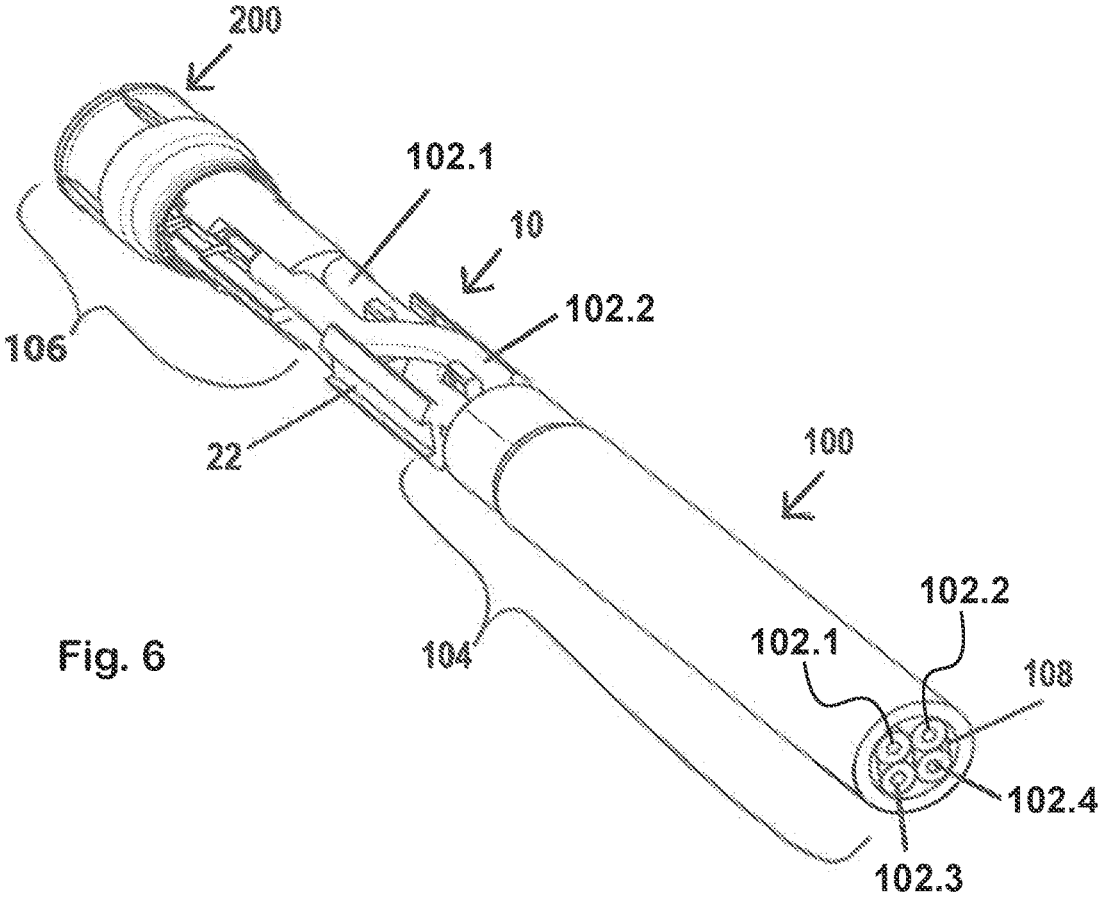
Figure 7:
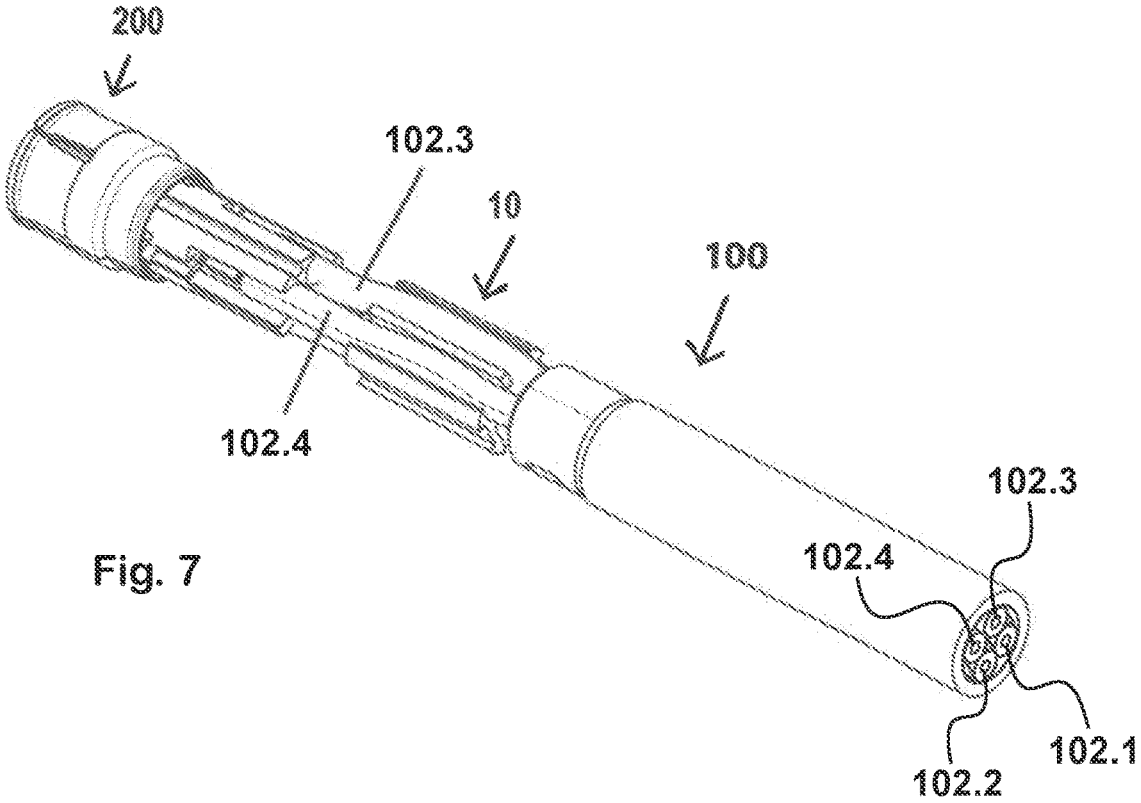

FIG. 4 schematically depicts an arrangement of guide tracks of the guide element of FIG. 1 at cross-section Y;

FIG. 4A schematically depicts an arrangement of guide tracks of the guide element of FIG. 1A at cross-section Y;

FIG. 5 schematically depicts an arrangement of guide tracks of the guide element of FIG. 1 at cross-section Z;

FIG. 5A schematically depicts an arrangement of guide tracks of the guide element of FIG. 1A at cross-section Z;

FIG. 6 shows a perspective view of a connector arrangement and a cable according to one embodiment of the invention;

FIG. 7 shows a perspective view of a connector arrangement and a cable according to one embodiment of the invention.

The enclosed figures of the drawing are intended to convey a deeper understanding of the embodiments of the invention. They illustrate embodiments and are used in connection with the description to provide an explanation of principles and concepts of the invention. Other embodiments and many of the advantages cited are obtained by reference to the drawings. The elements of the drawings are not necessarily shown true to scale.

In the figures of the drawing, identical, functionally equivalent and identically acting elements, features and components are each labelled with the same reference numeral, unless stated otherwise.

In the following the figures are described coherently and collectively.

DESCRIPTION OF EXEMPLARY EMBODIMENTS

Figure 2:
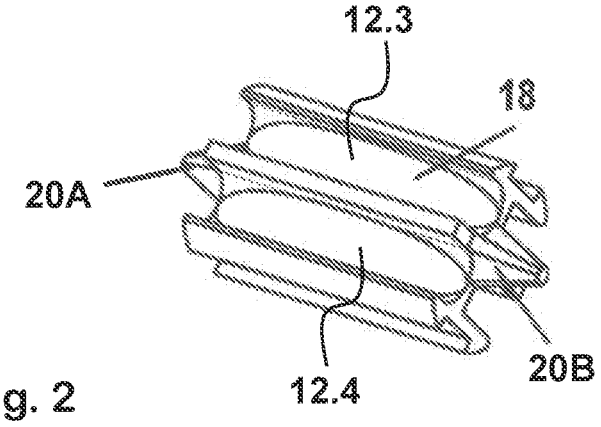
FIG. 2 shows a perspective view of a guide element according to one embodiment of the invention.
Figure 3:
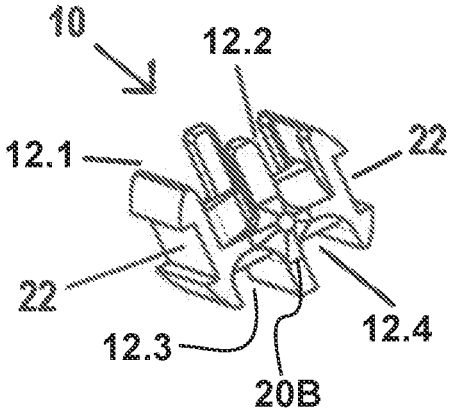
FIG. 3 shows a perspective view of a guide element according to one embodiment of the invention.

FIGS. 1, 2, and 3 each show a perspective view of a guide element 10 for four electrical cores. Accordingly, the guide element 10 has four guide tracks 12.1, 12.2, 12.3, 12.4, one for each electrical core.

As shown in FIG. 1 and schematically depicted in FIGS. 4 and 5, guide tracks 12.1 and 12.2 run in such a way that the arrangement of the cores 102.1 and 102.2 of the guide tracks 12.1 and 12.2 is reversed relative to the cores 102.3 and 102.4 of the guide tracks 12.3 and 12.4 between the first end 14 and the second end 16. As schematically depicted in FIG. 4, at cross-section Y in the arrangement shown in FIG. 1 guide track 12.1 neighbors guide tracks 12.2 and 12.3 and is diagonal to guide track 12.4. As schematically depicted in FIG. 5, at cross-section Z in the configuration shown in FIG. 1 guide track 12.1 neighbors guide tracks 12.2 and 12.4 and is diagonal to guide track 12.3.

As shown in FIG. 2, in the arrangement shown in FIG. 1 guide tracks 12.4 and 12.3 have a bend in order to compensate for the length offset resulting from the place exchange of the cores 102.1 and 102.2. The bend is a means 18 of compensating for the length offset.

The guide element 10 has a shield element 20A at the first end 14 and a shield element 20B at the second end 16. The shield elements 20A, 20B are designed as a star-shaped extension and shield the cores 12.1, 12.2, 12.3, 12.4 from each other in the region of the first end 14 or the second end 16. As a result of the star-shaped extension, an optimized transition from the cable arrangement into the guide element is ensured. This controls the mechanical trajectory of the cores and ensures a shielding in the transition region. The guide element also ensures an impedance control and shielding in the region of the guide element.

Figure 2A:
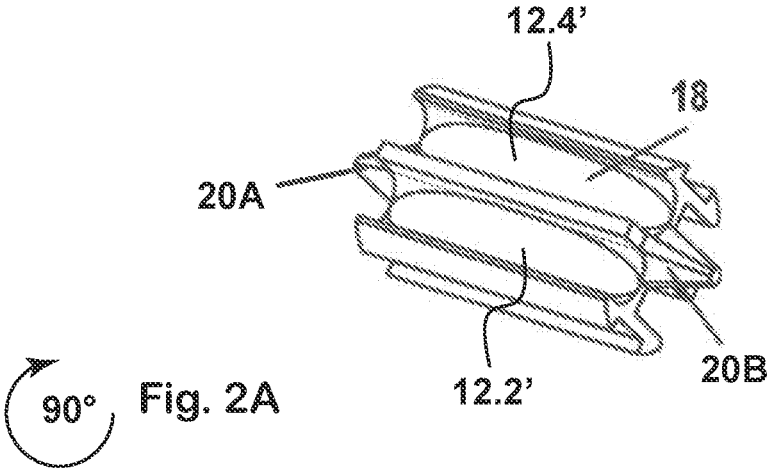
FIG. 2A shows a perspective view of an alternative configuration of the guide element of FIG. 2.
Figure 3A:
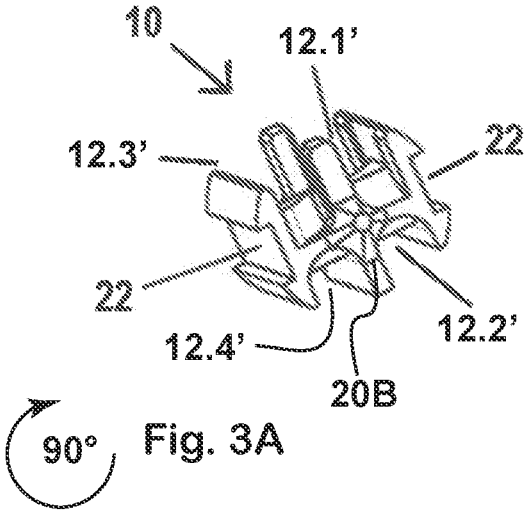
FIG. 3A shows a perspective view of an alternative configuration of the guide element of FIG. 3.

FIGS. 1A, 2A, and 3A each show a perspective view of an alternative configuration of guide element 10. In FIGS. 1A, 2A, and 3A, the guide element 10 again has four guide tracks 12.1', 12.2', 12.3', 12.4', albeit in a configuration that is rotated 90° relative to the configuration of FIGS. 1, 2, and 3.

Specifically, as shown in FIG. 1A and schematically depicted in FIGS. 4A and 5A, guide tracks 12.3' and 12.1' run in such a way that the arrangement of guide tracks 12.3' and 12.1' is reversed relative to guide tracks 12.2' and 12.4' between the first end 14 and the second end 16. As schematically depicted in FIG. 4A, at cross-section Y in the configuration shown in FIG. 1A guide track 12.1' neighbors guide tracks 12.2' and 12.3' and is diagonal to guide track 12.4'. As schematically depicted in FIG. 5A, at cross-section Z in the configuration shown in FIG. 1A guide track 12.1' neighbors guide tracks 12.3' and 12.4' and is diagonal to guide track 12.2'.

As shown in FIG. 2A, in the arrangement shown in FIG. 1A it is guide tracks 12.2' and 12.4' that may have a bend in order to compensate for the length offset resulting from the place exchange of the cores in guide tracks 12.3' and 12.1'.

Although the present invention has been fully described above on the basis of preferred exemplary embodiments, it is in fact not limited thereto, but can be modified in a wide variety of ways.

The guide element 10 has two grooves 22 on opposite sides. The grooves are used for fixing the guide element in a connector arrangement. For example, it can be provided that an insulating part engages in the grooves.

FIG. 6 shows a connector arrangement with a cable 100 and a connector 200. The cable 100 is designed as a "parallel pair" cable. Accordingly, the cores 102.1 and 102.3 or 102.2 and 102.4 in the cable each form a pair. Both pairs are shielded by a core-pair shield 108. The core-pair shield 108 is designed as a foil. The cable-side region of the cable 100 with respect to the guide element 10 forms the section 104.

FIG. 6 shows a perspective view of a connector arrangement from above. It goes without saying that the orientation "above" or "below" can be reversed.

FIG. 7 shows a perspective view of a connector arrangement from below.

The guide element 10 is located in an area of the cable 100 with the cladding removed. It is evident that the cores 102.1 and 102.2 cross over in the guide element 10. Accordingly, at the connector-side end of the guide element 10 the cores 102.1 and 102.3 or 102.2 and 102.4 each form pairs, whose counterparts are diagonally opposite each other. The connector-side region of the cable 100 with respect to the guide element 10 or the connector 200 forms the section 106 of the connector arrangement.

LIST OF REFERENCE SIGNS

10 guide element
12.1, 12.2, 12.3, 12.4 guide tracks
12.1', 12.2', 12.3', 12.4' guide tracks
102.1, 102.2, 102.3, 102.4 cores
14 first end
16 second end
18 means of compensation for the length offset
20A, 20B shield element
22 groove
100 cable
104 first section
106 second section
200 connector

The invention claimed is:

1. A guide, comprising:
a first guideway;
a second guideway:
a third guideway; and
a fourth guideway, wherein
in a first cross-section proximate to a first end of said guide said first guideway, said second guideway, said third guideway and said fourth guideway are arranged in a first cloverleaf-like arrangement,
in a second cross-section proximate to a second end of said guide said first guideway, said second guideway, said third guideway and said fourth guideway are arranged in a second cloverleaf-like arrangement,
in said first cloverleaf-like arrangement said first guideway neighbors said second guideway and said third guideway,
in said first cloverleaf-like arrangement said first guideway is diagonal to said fourth guideway,
said second cloverleaf-like arrangement is selected from the group consisting of a third cloverleaf-like arrangement and a fourth cloverleaf-like arrangement,
in said third cloverleaf-like arrangement said first guideway neighbors said second guideway and said fourth guideway,
in said third cloverleaf-like arrangement said first guideway is diagonal to said third guideway,
in said fourth cloverleaf-like arrangement said first guideway neighbors said third guideway and said fourth guideway, and
in said fourth cloverleaf-like arrangement said first guideway is diagonal to said second guideway.

2. The guide of claim 1, wherein:
said first guideway defines a first path,
said second guideway defines a second path,
said third guideway defines a third path,
said fourth guideway defines a fourth path,
a length of any one of said first path, said second path, said third path and said fourth path from a terminal end of the respective path to an opposite terminal end of the respective path is substantially equal to a length of any other of said first path, said second path, said third path and said fourth path from a terminal end of the other respective path to an opposite terminal end of the other respective path.

3. The guide of claim 1, wherein:
said second cloverleaf-like arrangement is said third cloverleaf-like arrangement,
said first guideway defines a first path,
said second guideway defines a second path,
said third guideway defines a third path,
said fourth guideway defines a fourth path,
said first path is a cross-over path,
said second path is a cross-over path,
said third path is a curved path, and
said fourth path is a curved path.

4. The guide of claim 1, wherein:
each of said third path and said fourth path is curved such that a length of any one of said first path, said second path, said third path and said fourth path from a terminal end of the respective path to an opposite terminal end of the respective path is substantially equal to a length of any other of said first path, said second path, said third path and said fourth path from a terminal end of the other respective path to an opposite terminal end of the other respective path.

5. The guide of claim 1, wherein:
said second cloverleaf-like arrangement is said third cloverleaf-like arrangement,
said first guideway defines a first path,
said second guideway defines a second path,
said third guideway defines a third path,
said fourth guideway defines a fourth path,
said first path is a cross-over path,
said second path is a curved path,
said third path is a cross-over path, and
said fourth path is a curved path.

6. The guide of claim 5, wherein:
each of said second path and said fourth path is curved such that a length of any one of said first path, said second path, said third path and said fourth path from a terminal end of the respective path to an opposite terminal end of the respective path is substantially equal to a length of any other of said first path, said second path, said third path and said fourth path from a terminal end of the other respective path to an opposite terminal end of the other respective path.

7. The guide of claim 1, comprising:
a first shielding element at a first end of said guide; and
a second shielding element at a second end of said guide opposite said first end.

8. The guide of claim 7, wherein:
said first shielding element has a cruciform cross-section,
a central axis of said first shielding element is substantially aligned with a central longitudinal axis of said guide,
said second shielding element has a cruciform cross-section, and
a central axis of said second shielding element is substantially aligned with said central longitudinal axis of said guide.

9. The guide of claim 1, comprising:
at least one groove on an outer surface of said guide.

10. The guide of claim 1, wherein:
each of said first path, said second path, said third path and said fourth path is substantially groove-shaped.

11. The guide of claim 1, wherein:
each of said first path, said second path, said third path and said fourth path is dimensioned to receive a respective one insulated conductor of a multi-core cable.

12. An assembly, comprising:
a cable;
a connector; and
a guide intermediate said cable and said connector, wherein
said cable comprises a first conductor, a second conductor, a third conductor and a fourth conductor,
said connector comprises a fifth conductor, a sixth conductor, a seventh conductor and an eighth conductor,
a longitudinal axis of said fifth conductor is generally aligned with a longitudinal axis of a portion of said first conductor in a sheathed portion of said cable adjacent said guide,
a longitudinal axis of said sixth conductor is generally aligned with a longitudinal axis of a portion of said second conductor in a sheathed portion of said cable adjacent said guide,
a longitudinal axis of said seventh conductor is generally aligned with a longitudinal axis of a portion of said third conductor in a sheathed portion of said cable adjacent said guide,
a longitudinal axis of said eighth conductor is generally aligned with a longitudinal axis of a portion of said fourth conductor in a sheathed portion of said cable adjacent said guide,
said guide comprises a first guideway that receives a portion of said first conductor, a second guideway that receives a portion of said second conductor, a third guideway that receives a portion of said third conductor and a fourth guideway that receives a portion of said fourth conductor,
said first conductor is electrically connected to said sixth conductor,
said second conductor is electrically connected to said fifth conductor,
said third conductor is electrically connected to said seventh conductor, and
said fourth conductor is electrically connected to said eighth conductor.

13. The assembly of claim 12, wherein:
a circumference of said guide is substantially equal to a circumference of at least one of said cable and said connector.

14. The assembly of claim 12, wherein:
said cable is a star-quad cable,
said first conductor and said fourth conductor constitute a first conductor pair of said star-quad cable,
said second conductor and said third conductor constitute a second conductor pair of said star-quad cable,
said connector comprises, as parallel pairs, a third conductor pair and a fourth conductor pair,
said fifth conductor and said seventh conductor constitute said third conductor pair, and
said sixth conductor and said eighth conductor constitute said fourth conductor pair.

15. The assembly of claim 12, wherein:
said cable is a parallel pair cable,
said first conductor and said third conductor constitute a first parallel conductor pair of said parallel pair cable,
said second conductor and said fourth conductor constitute a second parallel conductor pair of said parallel pair cable,
said fifth conductor and said eighth conductor constitute a first conductor pair of a quad-star arrangement, and
said sixth conductor and said seventh conductor constitute a second conductor pair of said quad-star arrangement.

16. An assembly, comprising:
a cable;
a connector; and
a guide intermediate said cable and said connector, wherein
said cable comprises a first conductor, a second conductor, a third conductor and a fourth conductor,
said connector comprises a fifth conductor, a sixth conductor, a seventh conductor and an eighth conductor,
a longitudinal axis of said fifth conductor is generally aligned with a longitudinal axis of a portion of said first conductor in a sheathed portion of said cable adjacent said guide,
a longitudinal axis of said sixth conductor is generally aligned with a longitudinal axis of a portion of said second conductor in a sheathed portion of said cable adjacent said guide,
a longitudinal axis of said seventh conductor is generally aligned with a longitudinal axis of a portion of said third conductor in a sheathed portion of said cable adjacent said guide, a longitudinal axis of said eighth conductor is generally aligned with a longitudinal axis of a portion of said fourth conductor in a sheathed portion of said cable adjacent said guide, said guide comprises a first guideway that receives a portion of said first conductor, a second guideway that receives a portion of said second conductor, a third guideway that receives a portion of said third conductor and a fourth guideway that receives a portion of said fourth conductor, said first conductor is electrically connected to said seventh conductor, said second conductor is electrically connected to said sixth conductor, said third conductor is electrically connected to said fifth conductor, and said fourth conductor is electrically connected to said eighth conductor.

17. The assembly of claim 16, wherein:

a circumference of said guide is substantially equal to a circumference of at least one of said cable and said connector.

18. The assembly of claim 16, wherein:

said cable is a star-quad cable, said first conductor and said fourth conductor constitute a first conductor pair of said star-quad cable, said second conductor and said third conductor constitute a second conductor pair of said star-quad cable, said connector comprises, as parallel pairs, a third conductor pair and a fourth conductor pair, said fifth conductor and said sixth conductor constitute said third conductor pair, and said seventh conductor and said eighth conductor constitute said fourth conductor pair.

19. The assembly of claim 16, wherein:

said cable is a parallel pair cable, said first conductor and said second conductor constitute a first parallel conductor pair of said parallel pair cable, said third conductor and said fourth conductor constitute a second parallel conductor pair of said parallel pair cable, said fifth conductor and said eighth conductor constitute a first conductor pair of a quad-star arrangement, and said sixth conductor and said seventh conductor constitute a second conductor pair of said quad-star arrangement.

20. An assembly, comprising:

a cable;

a connector; and a guide intermediate said cable and said connector, wherein said cable comprises a first conductor, a second conductor, a third conductor and a fourth conductor, said connector comprises a plurality of conductors, each of said first conductor, said second conductor, said third conductor and said fourth conductor electrically contacts a respective one of said plurality of conductors, said guide comprises a first guideway that receives a portion of said first conductor, a second guideway that receives a portion of said second conductor, a third guideway that receives a portion of said third conductor and a fourth guideway that receives a portion of said fourth conductor, in a first cross-section proximate to a first end of said guide said first guideway, said second guideway, said third guideway and said fourth guideway are arranged in a first cloverleaf-like arrangement, in a second cross-section proximate to a second end of said guide said first guideway, said second guideway, said third guideway and said fourth guideway are arranged in a second cloverleaf-like arrangement, in said first cloverleaf-like arrangement said first guideway neighbors said second guideway and said third guideway, in said first cloverleaf-like arrangement said first guideway is diagonal to said fourth guideway, said second cloverleaf-like arrangement is selected from the group consisting of a third cloverleaf-like arrangement and a fourth cloverleaf-like arrangement, in said third cloverleaf-like arrangement said first guideway neighbors said second guideway and said fourth guideway, in said third cloverleaf-like arrangement said first guideway is diagonal to said third guideway, in said fourth cloverleaf-like arrangement said first guideway neighbors said third guideway and said fourth guideway, and in said fourth cloverleaf-like arrangement said first guideway is diagonal to said second guideway.

21. The assembly of claim 20, wherein:

said plurality of conductors comprises a fifth conductor, a sixth conductor, a seventh conductor and an eighth conductor, a longitudinal axis of said fifth conductor is generally aligned with a longitudinal axis of a portion of said first conductor in a sheathed portion of said cable adjacent said guide, a longitudinal axis of said sixth conductor is generally aligned with a longitudinal axis of a portion of said second conductor in a sheathed portion of said cable adjacent said guide, a longitudinal axis of said seventh conductor is generally aligned with a longitudinal axis of a portion of said third conductor in a sheathed portion of said cable adjacent said guide, a longitudinal axis of said eighth conductor is generally aligned with a longitudinal axis of a portion of said fourth conductor in a sheathed portion of said cable adjacent said guide, said first conductor electrically contacts said sixth conductor, said second conductor electrically contacts said fifth conductor, said third conductor electrically contacts said seventh conductor, and said fourth conductor electrically contacts said eighth conductor.

22. The assembly of claim 20, wherein:

said plurality of conductors comprises a fifth conductor, a sixth conductor, a seventh conductor and an eighth conductor, a longitudinal axis of said fifth conductor is generally aligned with a longitudinal axis of a portion of said first conductor in a sheathed portion of said cable adjacent said guide, a longitudinal axis of said sixth conductor is generally aligned with a longitudinal axis of a portion of said second conductor in a sheathed portion of said cable adjacent said guide, a longitudinal axis of said seventh conductor is generally aligned with a longitudinal axis of a portion of said third conductor in a sheathed portion of said cable adjacent said guide, a longitudinal axis of said eighth conductor is generally aligned with a longitudinal axis of a portion of said fourth conductor in a sheathed portion of said cable adjacent said guide, said first conductor electrically contacts said seventh conductor, said second conductor electrically contacts said sixth conductor, said third conductor electrically contacts said fifth conductor, and said fourth conductor electrically contacts said eighth conductor.

* * * * *